US012263921B1

(12) United States Patent
Pienta

(10) Patent No.: US 12,263,921 B1
(45) Date of Patent: Apr. 1, 2025

(54) MARINE VESSELS HAVING A MODIFIABLE WAKE AND DEVICES FOR MODIFYING A WAKE OF A MARINE VESSEL

(71) Applicant: Brunswick Corporation, Mettawa, IL (US)

(72) Inventor: Matthew C. Pienta, New Smyrna Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 635 days.

(21) Appl. No.: 17/569,910

(22) Filed: Jan. 6, 2022

(51) Int. Cl.

| | |
|---|---|
| ***B63B 34/75*** | (2020.01) |
| ***B63B 1/32*** | (2006.01) |
| ***B63B 34/70*** | (2020.01) |
| ***B63B 39/06*** | (2006.01) |
| ***B63B 79/10*** | (2020.01) |
| ***B63B 79/40*** | (2020.01) |
| ***B63H 20/10*** | (2006.01) |

(52) U.S. Cl.
CPC ..... *B63B 34/75* (2020.02); *B63B 1/32* (2013.01); *B63B 34/70* (2020.02); *B63B 39/06* (2013.01); *B63B 79/10* (2020.01); *B63B 79/40* (2020.01); *B63H 20/10* (2013.01); *B63B 2039/065* (2013.01)

(58) Field of Classification Search
CPC ... B63B 34/70; B63B 34/75; B63B 2001/281; B63B 1/30; B63B 1/32; B63B 2001/325; B63B 39/06; B63B 39/061; B63B 2039/065
See application file for complete search history.

(56) References Cited

U.S. PATENT DOCUMENTS

| | | | | |
|---|---|---|---|---|
| 1,196,682 A * | 8/1916 | Harriss | ..... | B63H 25/44 114/145 R |
| 5,819,678 A * | 10/1998 | Austin | ..... | B63B 41/00 114/126 |
| 6,138,601 A | 10/2000 | Anderson et al. | | |
| 6,520,104 B1 | 2/2003 | Svensson | | |

(Continued)

FOREIGN PATENT DOCUMENTS

| | | |
|---|---|---|
| CA | 2271332 A1 * | 2/2000 |
| JP | 61119489 A * | 6/1986 |

(Continued)

*Primary Examiner* — Ajay Vasudeva
(74) *Attorney, Agent, or Firm* — Andrus Intellectual Property Law, LLP

(57) ABSTRACT

A device for modifying a wake of a marine vessel having a hull. The hull extends between a bow and a transom in a longitudinal direction and between sides in a lateral direction perpendicular to the longitudinal direction. The sides each extend between a top and a bottom in a vertical direction that is perpendicular to the longitudinal direction and to the lateral direction. A panel is movably coupled to one of the sides of the hull and movable into and between a stowed position and a deployed position. In the stowed position, the panel extends along the one of the sides of the hull. The panel moves laterally outwardly away from the one of the sides of the hull when moving toward the deployed position. Moving the panel from the stowed position to the deployed position causes the panel to modify the wake of the marine vessel.

20 Claims, 8 Drawing Sheets

(56) References Cited

U.S. PATENT DOCUMENTS

| | | | | |
|---|---|---|---|---|
| 6,827,031 | B2 * | 12/2004 | Aoyama | B63H 25/44 114/284 |
| 7,188,581 | B1 | 3/2007 | Davis et al. | |
| 8,113,892 | B1 | 2/2012 | Gable et al. | |
| 8,539,897 | B1 | 9/2013 | Gasper et al. | |
| 8,833,286 | B1 | 9/2014 | Sheedy et al. | |
| 9,032,897 | B2 * | 5/2015 | Argo | B63B 1/18 114/271 |
| 9,278,740 | B1 | 3/2016 | Andrasko et al. | |
| 9,315,235 | B1 | 4/2016 | Wood | |
| 9,359,057 | B1 | 6/2016 | Andrasko et al. | |
| 9,611,006 | B1 | 4/2017 | Miller | |
| 10,040,522 | B1 | 8/2018 | Hartman et al. | |
| 10,137,971 | B2 | 11/2018 | Andraso et al. | |
| 11,066,135 | B1 * | 7/2021 | Wang | B63B 34/75 |
| 11,230,356 | B2 * | 1/2022 | Eberhardt | B63B 32/40 |
| 11,370,508 | B1 * | 6/2022 | Dugger | B63B 34/75 |
| 2017/0038771 | A1 | 2/2017 | Green et al. | |
| 2021/0354793 | A1 | 11/2021 | Wang | |

FOREIGN PATENT DOCUMENTS

| | | | | |
|---|---|---|---|---|
| JP | H05178282 | A | * | 7/1993 |
| KR | 20160106817 | A | * | 9/2016 |

* cited by examiner

MARINE VESSELS HAVING A MODIFIABLE WAKE AND DEVICES FOR MODIFYING A WAKE OF A MARINE VESSEL

FIELD

The present disclosure generally relates to marine vessels having a modifiable wake and devices for modifying a wake of a marine vessel.

BACKGROUND

The following U.S. Patents provide background information and are incorporated by reference in entirety.

U.S. Pat. No. 10,137,971 discloses a trim control system that automatically controls trim angle of a marine propulsion device with respect to a vessel. A memory stores trim base profiles, each defining a unique relationship between vessel speed and trim angle. An input device allows selection of a base profile to specify an aggressiveness of trim angle versus vessel speed, and then optionally to further refine the aggressiveness. A controller then determines a setpoint trim angle based on a measured vessel speed.

U.S. Pat. No. 9,359,057 discloses a system for controlling movement of drive units on a marine vessel with a control circuit connected to each drive unit. When the marine vessel is turning, the control circuit defines one of the drive units as an inner drive unit and another of the drive units as an outer drive unit. The control circuit calculates an inner drive unit steering angle and an outer drive unit steering angle and sends control signals to actuate the inner and outer drive units to the inner and outer drive unit steering angles, respectively, so as to cause each of the inner and outer drive units to incur substantially the same hydrodynamic load while the marine vessel is turning.

U.S. Pat. No. 9,278,740 discloses a system for controlling an attitude of a marine vessel having first and second trim tabs, which includes a controller having vessel roll and pitch control sections. The pitch control section compares an actual vessel pitch angle to a predetermined desired vessel pitch angle and outputs a deployment setpoint that is calculated to achieve the desired pitch angle. The roll control section compares an actual vessel roll angle to a predetermined desired vessel roll angle, and outputs a desired differential between the first and second deployments that is calculated to maintain the vessel at the desired vessel roll angle. When the controller determines that the magnitude of a requested vessel turn is greater than a first predetermined threshold, the controller decreases the desired differential between the first and second deployments, and accounts for the decreased desired differential deployment in its calculation of the first and second deployments.

U.S. Pat. No. 8,113,892 discloses a marine propulsion control system that receives manually input signals from a steering wheel or trim switches and provides the signals to first, second, and third controllers. The controllers cause first, second, and third actuators to move control devices. The actuators can be hydraulic steering actuators or trim plate actuators. Only one of the plurality of controllers requires connection directly to a sensor or switch that provides a position signal because the controllers transmit signals among themselves. These arrangements allow the various positions of the actuated components to vary from one device to the other as a result of calculated positions based on a single signal provided to one of the controllers.

U.S. Pat. No. 7,188,581 discloses a marine drive, a marine vessel, and drive combination have a trim tab with a forward end pivotally mounted to a marine propulsion device.

U.S. Pat. No. 6,138,601 discloses a Vee bottom planing boat hull with right and left steps positioned so as to optimize the boat's trim angle at top speed, and defining right and left notches in which are pivotally mounted left and right trim tabs having forward leading edges along oblique pivot axes causing outer corners of trailing edges of the trim tabs to move downwardly more than inner corners during downward pivoting of the trim tabs. This provides an active hull to control boat trim angle and effectively reduce deadrise angle while maintaining a running surface trailing edge substantially free of discontinuities in the vertical direction.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a device for modifying a wake of a marine vessel having a hull. The hull extends between a bow and a transom in a longitudinal direction and between sides in a lateral direction perpendicular to the longitudinal direction. The sides each extend between a top and a bottom in a vertical direction that is perpendicular to the longitudinal direction and perpendicular to the lateral direction. The device includes a panel movably coupled to one of the sides of the hull and movable into and between a stowed position and a deployed position. In the stowed position, the panel extends along the one of the sides of the hull. The panel moves laterally outwardly away from the one of the sides of the hull when moving toward the deployed position. Moving the panel from the stowed position to the deployed position causes the panel to modify the wake of the marine vessel.

Another embodiment generally relates to a marine vessel having a modifiable wake. The marine vessel includes a hull that extends between a bow and a transom in a longitudinal direction and between first and second sides in a lateral direction perpendicular to the longitudinal direction. The first and second sides each extend between a top and a bottom in a vertical direction that is perpendicular to the longitudinal direction and perpendicular to the lateral direction. Two panels are movably coupled to the first and second sides of the hull, respectively, each being movable into and between a stowed position and a deployed position. In the stowed position the two panels extend along the first and second sides of the hull, respectively. The two panels move laterally outwardly away from the first and second sides of the hull, respectively, when moving toward the deployed position. Moving either of the two panels from the stowed position to the deployed position modifies the wake of the marine vessel.

Various other features, objects and advantages of the disclosure will be made apparent from the following description taken together with the drawings.

BRIEF DESCRIPTION OF THE DRAWINGS

The present disclosure is described with reference to the following drawings.

DETAILED DISCLOSURE

Figure 1:
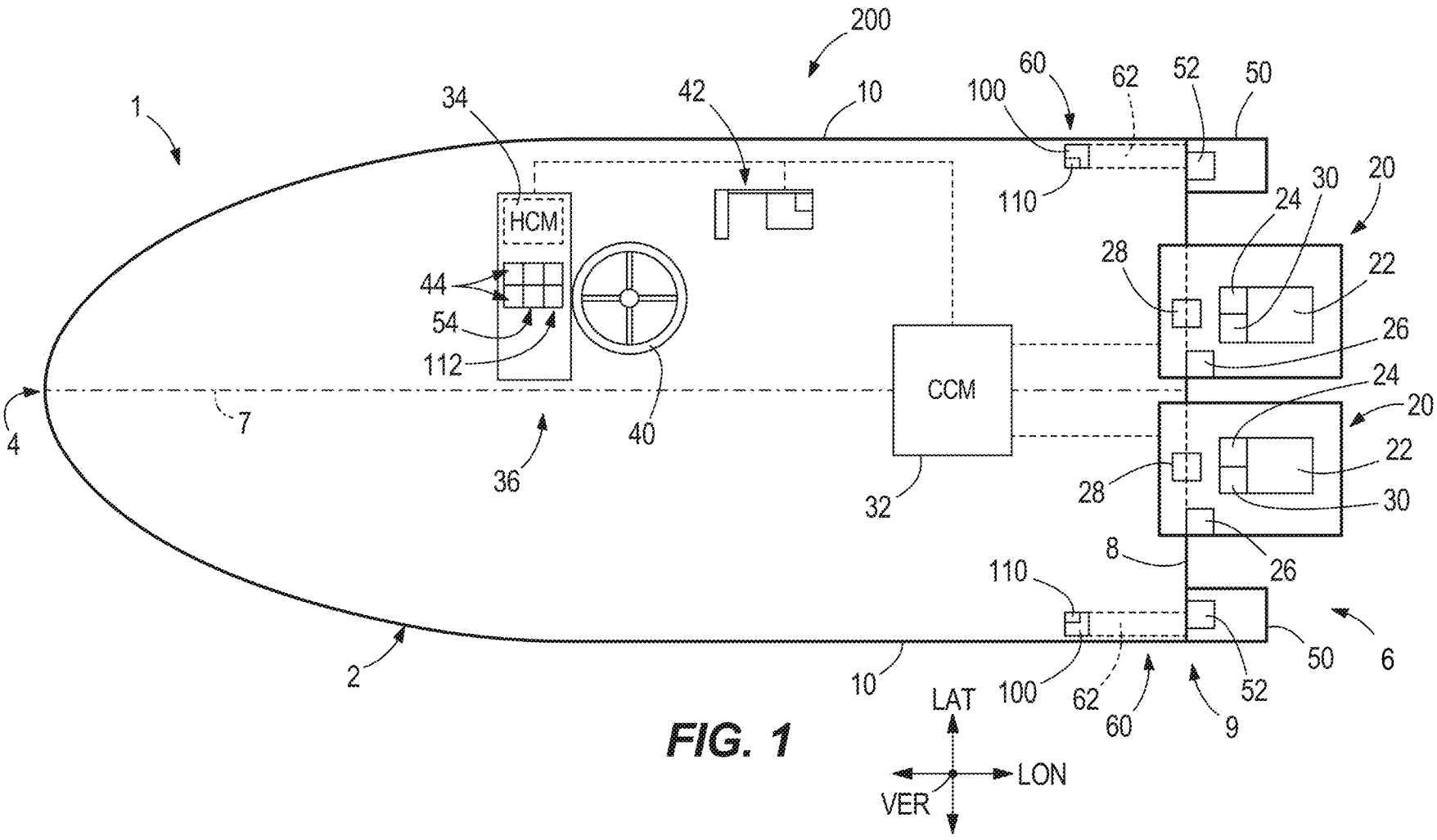
FIG. 1 is an overhead schematic view of a marine vessel having devices for modifying a wake according to the present disclosure.
Figure 2:
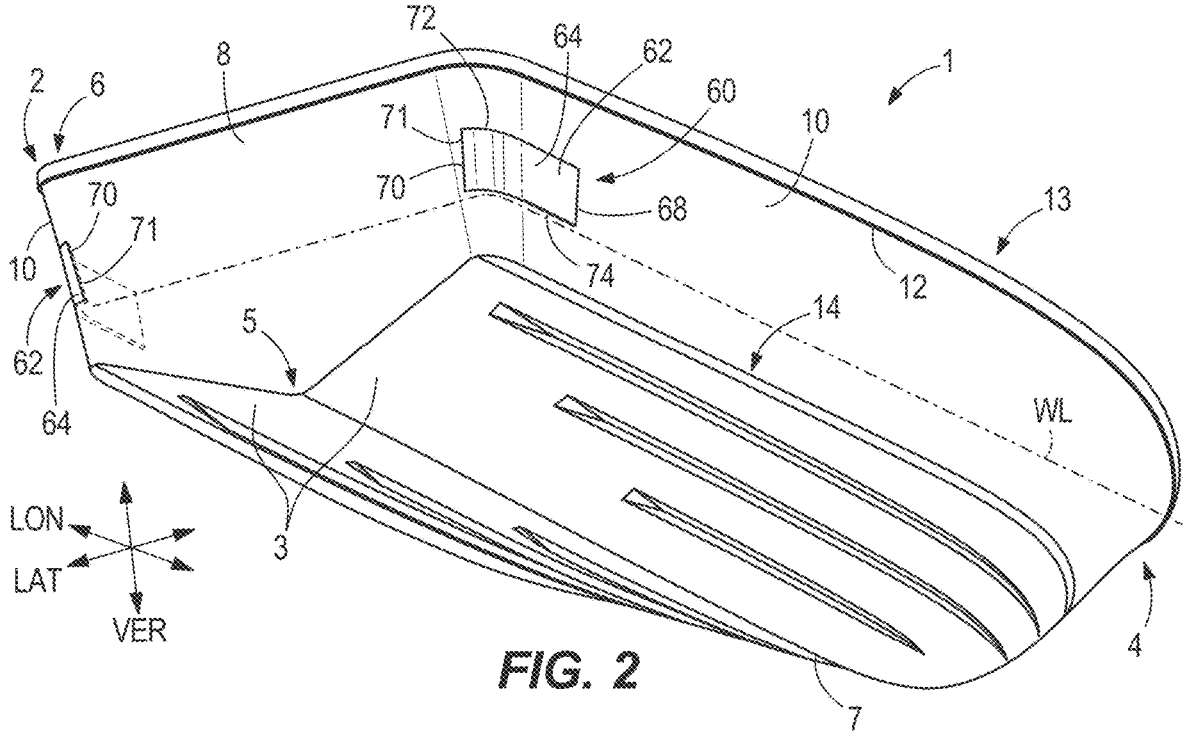
FIG. 2 is a rear perspective view of a marine vessel with devices for modifying a wake according to the present disclosure in stowed positions.

The present disclose relates to marine vessels having a modifiable wake, and devices for modifying a wake of a marine vessel, such as to create a surfable wake behind the marine vessel for wake surfing. FIG. 1 depicts a marine vessel 1 having a hull 2 that extends in a longitudinal direction between a bow 4 and a stern 6 with a transom 8 located at the stern 6. The hull 2 further extends between sides 10 in a lateral direction that is perpendicular to the longitudinal direction. As shown in FIG. 2, the sides 10 of the hull 2 each extend between a top 12 and a bottom 14 in a vertical direction that is perpendicular to both the longitudinal direction and perpendicular to the lateral direction. A rub rail 13 is provided above the top 12 of the hull 2 in a conventional manner. Undersides 3 of the hull 2 extend vertically downwardly and laterally inwardly from the bottoms 14 of the sides 10. The undersides 3 meet at a keel 5 that extends longitudinally along a centerline 7 between the bow 4 and the stern 6.

Returning to FIG. 1, the marine vessel 1 includes two propulsors 20 configured to generate thrust to propel the marine vessel 1 through water in a conventional manner. The two propulsors 20 each have a powerhead 22 (e.g., an electric motor, an internal combustion engine, or a hybrid thereof) coupled in a torque-transmitting relationship with a propeller (not shown) to propel the marine vessel 1 in a manner known in the art. The two propulsors 20 are presently shown as outboard motors, but could alternatively be inboard motors, stern drives, pod drives, outboard motors having steerable gearcases (such as disclosed in U.S. Pat. No. 10,800,502, which is incorporated herein in its entirety), jet drives, and/or any other devices configured to propel a marine vessel 1. The powerheads 22 are operated via a "drive-by-wire" control system such as described in U.S. Pat. No. 7,941,253, which is incorporated by reference herein in its entirety. Each propulsor 20 further includes a powerhead speed sensor 24 (e.g., a Hall-effect sensor) that measures the rotational speed of the powerhead 22 in rotations per minute (RPM) in a manner known in the art.

The propulsors 20 are steerable via steering actuators 26 as a "steer-by-wire" system in a manner known in the art, for example via electric motors, hydraulic actuators, and/or pneumatic actuators (see U.S. Pat. Nos. 7,150,664; 7,255,616; 7,467,595; and 8,113,892, which are incorporated by reference herein in their entireties). The trim angle of each of the propulsors 20 is also adjustable in a manner known in the art, specifically by control of trim actuators 28 (which may also be electric, hydraulic, and/or pneumatic as described in U.S. Pat. No. 10,137,971, which is incorporated by reference herein in its entirety). Each propulsor 20 also includes an engine control module 30 (ECM 30) that receives signals for operating the propulsors 20 in a manner known in the art, including the powerhead 22, the steering actuators 26, and trim actuators 28. For clarity, the term engine control module 30 is used referred even where the powerhead 22 does not include an internal combustion engine.

With continued reference to FIG. 1, the engine control modules 30 each communicate with a central control module 32 (CCM 32), with the central control module 32 also communicating with a helm control module 34 (HCM 34) at a helm 36 of the marine vessel 1 in a conventional manner. Additional information regarding these elements, which together form a control system 200, is provided below.

The helm 36 includes a number of operator input devices through which an operator can input commands for controlling the marine vessel 1. These commands are received by the HCM 34 and communicated to the CCM 32 for controlling the ECMs 30 in the propulsors 20. The helm 36 of FIG. 1 includes a steering device, such as a steering wheel 40, which inputs steering commands for operating the steering actuators 26 to steer the marine vessel 1 in a manner known in the art. A throttle lever 42 is operable for providing thrust commands for the powerheads 22, including both a magnitude and a direction of thrust. The helm 36 further includes trim controls 44 (e.g., rocker switches or touchscreen controls) for adjusting the trim angles of the propulsors 20 via the trim actuators 28 in a manner known in the art.

The marine vessel 1 of FIG. 1 is further provided with conventionally known trim tabs 50 that are operable to adjust the lift and/or roll of the marine vessel 1 when underway. The trim tabs 50 extend longitudinally rearwardly from the transom 8 and are adjustable via trim tab actuators 52, which may be electric, pneumatic, and/or hydraulically actuated in a manner known in the art. Additional information regarding trim tabs presently known in the art is provided in the background patents incorporated by reference above. Control of the trim tab actuators 52 is provided via trim tab controls 54 at the helm 36 (e.g., rocker switches or touchscreen controls), which allow the operator to adjust the positions of the trim tabs 50 together or independently.

Figure 3:
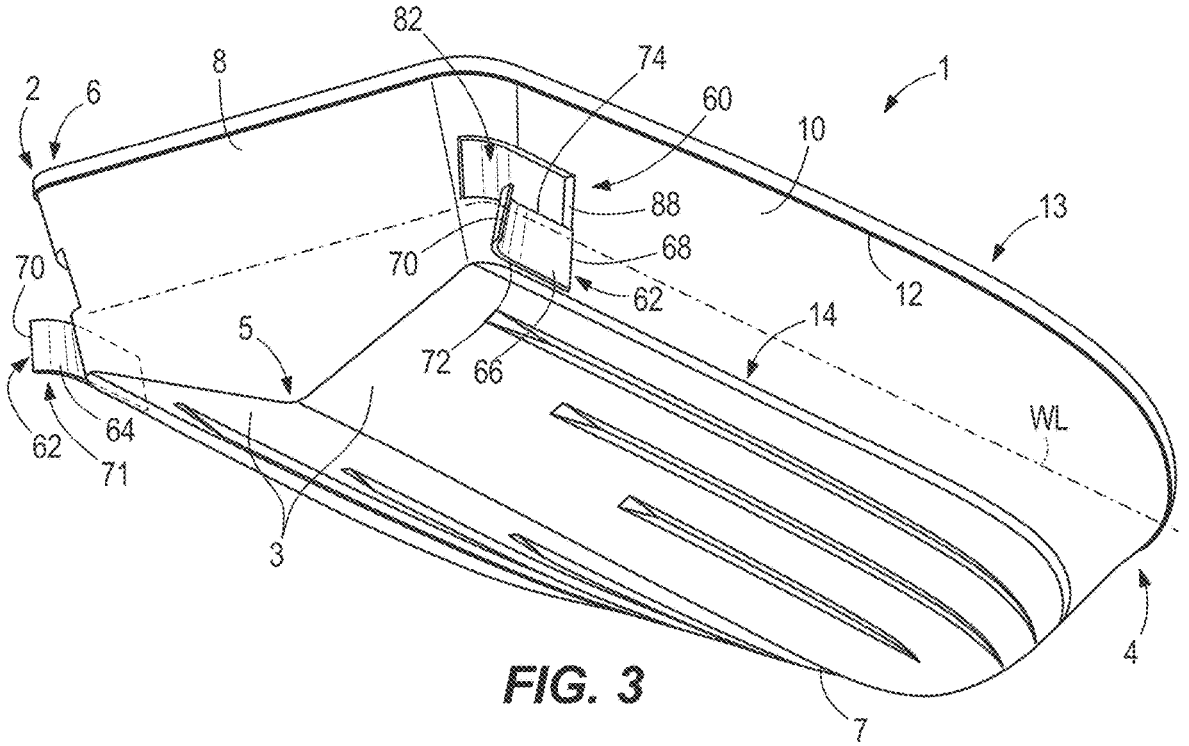
FIG. 3 shows the marine vessel of FIG. 2 with the devices in deployed positions.

With reference to FIGS. 2-3, the present inventor has developed the presently disclosed devices 60 for modifying the wake of a marine vessel 1. A device 60 is provided for each of the sides 10 of the marine vessel 1, which allows for selectively modifying the wake on either side 10 of the marine vessel 1 as needed. Each device 60 includes a panel 62 that is movably coupled to one of the sides 10 of the hull 2, in particular being movable into and between a stowed position (FIG. 2) and a deployed position (FIG. 3), as discussed further below. The panel 62 may be formed of fiberglass, plastics, aluminum, or other materials used for producing hulls or trim tabs, in certain embodiments being selected to match the material of the hull to which the panel 62 is movably coupled.

Figure 4:
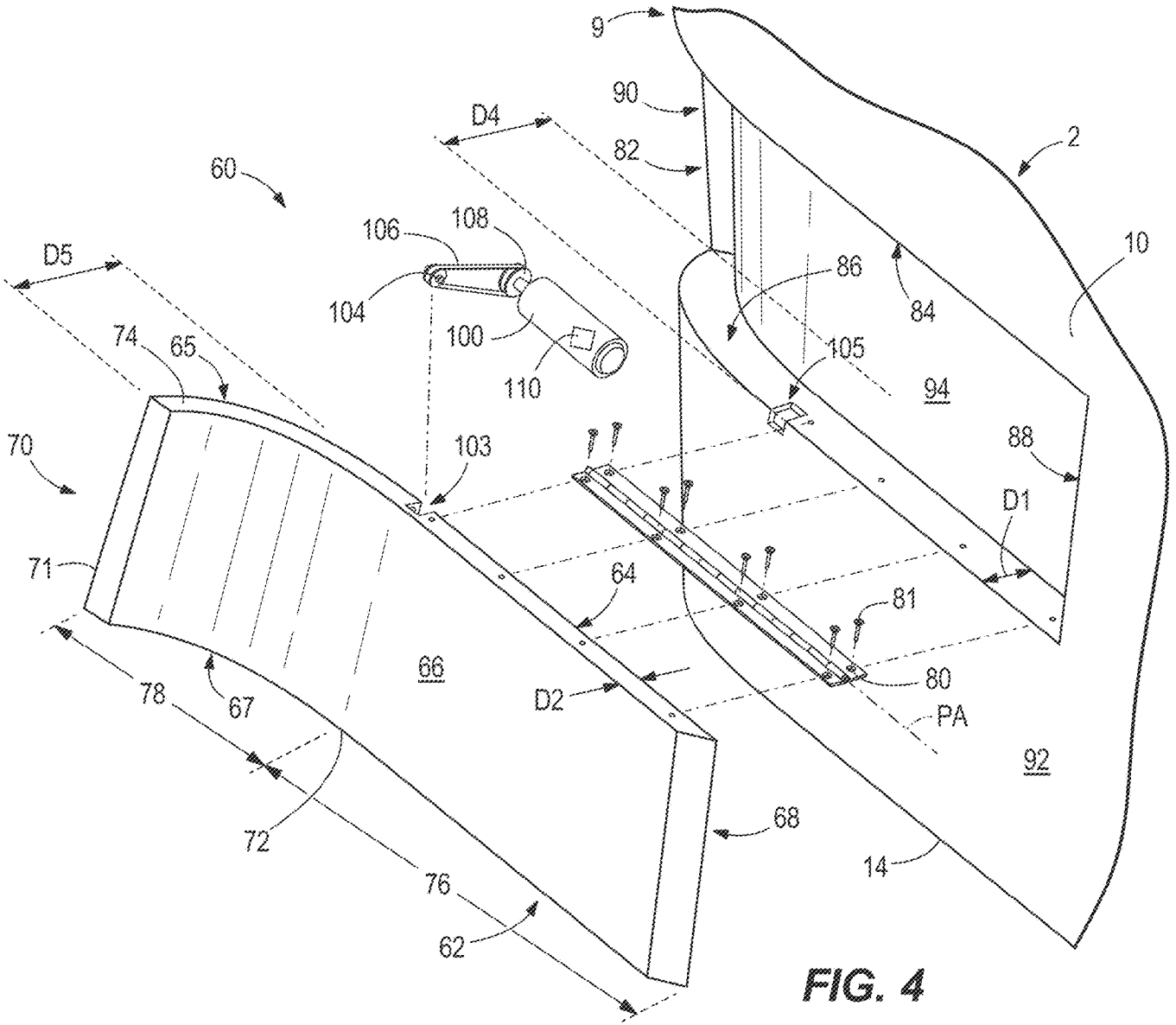
FIG. 4 is an exploded perspective view of one of the devices from FIG. 3.

FIG. 4 is an exploded view of one of the devices 60 of FIG. 3 in the deployed position. The panel 62 has a first side 64 opposite a second side 66 that extend between a front end 68 and an opposite rear end 70, and also between a free end 72 and an opposite fixed end 74. When the panel 62 is in the deployed position as shown, the rear end 70 is longitudinally closer than the front end 68 to the transom 8 and the fixed end 74 is vertically closer than the free end 72 to the top 12 of the side 10 of the hull 2. The front end 68 is ramped such that at the front end 68 the first side 64 is longitudinally closer than the second side 66 to the bow when the panel 62 is in the deployed position. The panel 62 is configured such that the free end 72 is approximately vertically even with the bottom 14 of the side 10 of the hull 2 when in the deployed position. The present inventor has recognized that by aligning the free end 72 and the bottom 14 of the hull side 10, all of the water flowing along the hull side 10 during operation is captured and redirected outwards and down. Moreover, this alignment minimizes the drag produced by the device 60 being in the deployed position.

The panel 62 is divisible between the front end 68 and the rear end 70 into a first section 76 and a second section 78. Within the first section 76, the first side 64 and the second side 66 are generally planar and parallel to each other. The second section 78 is not coplanar with the first section 76 and extends at an angle thereto. Within the second section 78 of the panel 62 in FIG. 4, the first side 64 forms a convex surface 65 and the second side 66 forms a concaved surface 67 extending to the rear end 70 and the panel 62. A lateral end 71 at the rear end 70 extends a distance D5 from the first side 64 of the panel 62. However, it should be recognized that other geometries are contemplated by the present disclosure and are discussed further below. In this manner, the lateral end 71 of the panel 62 at the rear end 70 is laterally father away from the side 10 of the hull 2 in the deployed position than in the stowed position due to the shape and configuration of the panel 62, particularly within the second section 78.

With continued reference to FIG. 4, the fixed end 74 of the panel 62 is pivotally coupled to the side 10 of the hull 2 via a hinge 80 (e.g., a piano-type hinge), which is pivotable about a pivot axis PA. Fasteners such as screws 81, bolts, or rivets couple the hinge 80 to the hull 2 and to the fixed end 74 of the panel 62. The panel 62 is therefore pivotable about the pivot axis PA of the hinge 80 between the stowed position (FIG. 2) in which the first side 64 faces outwardly away from the hull 2 and the second side 66 faces inwardly toward the hull 2, and the deployed position (FIG. 4) in which the first side 64 faces inwardly toward the hull 2 and the second side 66 faces outwardly away from the hull 2. In the embodiment shown in FIGS. 2-4, the shape and position of the panel 62 relative to the hull 2 also provide that the rear end 70 of the panel 62 wraps around an aft corner 9 of the hull 2 when in the stowed position. In this configuration, the second side 66 of the panel 62 also faces toward the transom 8 when in the stowed position.

The present disclosure also contemplates other mechanisms for moving the panel 62 between the stowed position and the deployed position. In certain alternate embodiments, the second side 66 faces laterally outwardly away from the side 10 of the hull 2 in both the stowed position and the deployed position. In particular, the panel 62 is movably coupled to the side 10 of the hull 2 via a drawer slide to move vertically between the stowed position and the deployed position.

The hull 2 of FIG. 4 further includes a recess 82 formed in each of sides 10. Each recess 82 has a top 84, a bottom 86, a front end 88, and a rear end 90. The hinge 80 is coupled to the hull 2 at the bottom 86 of the recess 82 so as to be protected and non-visible when the panel 62 is in the stowed position. The recess 82 formed in each side 10 also wraps around the aft corner 9 where the side 10 meets the transom 8, thereby also being formed in the transom 8. The rear end 90 of the recess 82 is therefore formed in the transom 8. Within the transom 8, the recess 82 extends laterally inwardly from the side 10 by a distance D4 corresponding to the distance D5 between the lateral end 71 of the panel 62 and the first side 64 of the panel 62. The present disclosure contemplates configurations in which the hull 2 does not form a recess 82, the recess 82 is formed only in one or more of the sides 10 (i.e., not in the transom 8), the recess 82 is formed only in the transom 8 (i.e., not in either side 10), and/or where separate recesses are formed in the side 10 and in the transom 8 that are not continuous with each other.

With continued reference to FIG. 4, the recess 82 extends inwardly to an inner surface 94 by a depth D1 from an outer surface 92 of the side 10. The depth D1 of the recess 82 corresponds to a depth D2 between the first side 64 and the second side 66 of the panel 62. The depth D2 may vary between the front end 68 and the rear end 70 of the panel 62, and likewise the depth D1 within the recess 82 in the side 10. In this manner, the recess 82 in the hull 2 and in the transom 8 is configured such that the panel 62 is at least partially positioned within the recess 82 when the panel 62 is in the stowed position (FIG. 2), here being flush with the outer surface 92 of the side 10 and the transom 8 when in the stowed position.

Figure 5:
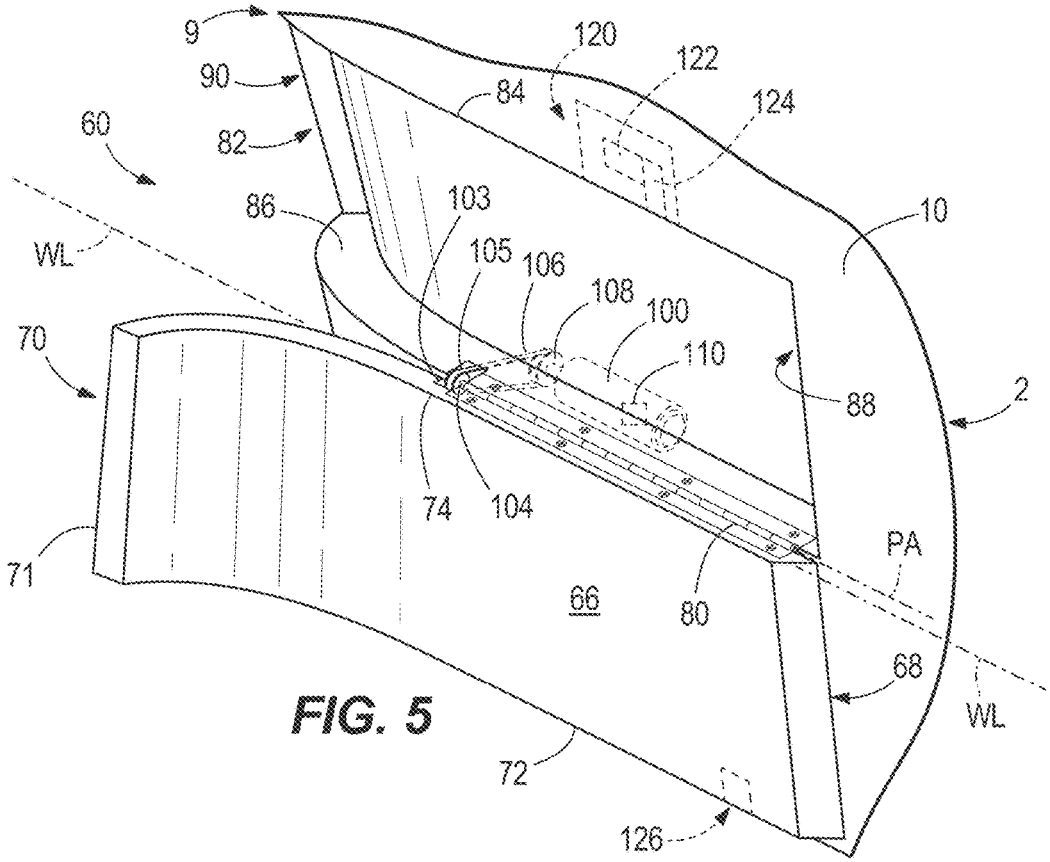
FIG. 5 shows the device of FIG. 4 assembled and with a first type of actuator.

FIGS. 4-5 also show an actuator, here a rotary actuator 100, configured to move the panel 62 between the stowed and deployed positions. One example of a pneumatically operated rotary actuator is the Anodized Aluminum Vane Style Rotary Actuator produced by Speedaire, model number CRB1BW100-180S. One example of an electrically operator servo motor usable as the rotary actuator is the RDrive servo by Rozum Robotics. A first gear 104 is non-rotatably coupled to the panel 62 (e.g., via screws, bolts, or being integrally formed therewith), where the first gear 104 is centered about the pivot axis PA of the hinge 80. The first gear 104 is positioned within a notch 103 formed in the fixed end 74 and in the first side 64 of the panel 62 such that the first gear 104 is at least partially recessed within the notch 103. The first gear 104 is rotatably coupled via a chain 106 to a second gear 108 that is rotated by the rotary actuator 100, which here is an electric motor. In other embodiments, the first gear 104 and the second gear 108 directly mesh together, or are rotatably coupled via a belt.

The notch 103 in the panel 62 provides clearance for the first gear 104 and the chain 106 to rotate without interfering with the panel 62. An opening 105 is also formed in the bottom 86 of the recess 82 and in the outer surface 92 of the side 10 of the hull 2. The opening 105 aligns with the notch 103 to provide clearance for the chain 106 and the first gear 104, and also enables the chain 106 to extend through the outer surface 92 of the hull 2 such that the second gear 108 and the rotary actuator 100 may be positioned laterally inwardly from the outer surface 92. In this manner, rotation of the rotary actuator 100 rotates the second gear 108, which rotates the first gear 104 via the chain 106 to thereby pivot the panel 62 about the pivot axis PA of the hinge 80.

An encoder 110 within the rotary actuator 100 measures the rotational position of the rotary actuator 100 (and thus the second gear 108 coupled thereto). The rotational position measured by the encoder 110 is used to set limits for rotating the rotary actuator 100 so as to prevent rotation of the panel 62 beyond the stowed position and beyond the deployed position. Likewise, the rotational position is used to determine the position of the panel 62 between the deployed position and the stowed position. In certain embodiments, the hull 2 and the panel 62 are configured such that the panel 62 moves at least 150 degrees between the stowed and deployed positions (which is approximately 180 degrees in the present configuration).

Returning to FIG. 1, the rotary actuator 100 is controlled by panel controls 112 at the helm 36, which may be rocker switches or touchscreen controls like the trim controls 44 discussed above. In certain embodiments, the control system 200 is configured such that a momentary actuation of one of the panel controls 112 causes the corresponding rotary actuator 100 to operate until the associated panel 62 is fully in the stowed position, or fully in the deployed position, depending on the selection by the operator. As discussed above, the rotary actuator 100 may be automatically stopped based on the rotational position measured by the encoder 110 associated therewith.

With reference to FIGS. 2 and 3, the device 60 and hull 2 are configured such that when in the stowed position of FIG. 2, the panel 62 is above the waterline WL, thereby avoiding drag, fouling, and damage to components. Moving the panel 62 into the deployed position of FIG. 3 then causes the panel 62 to move such that it is at least partially below the waterline WL, thereby modifying the wake of the marine vessel 1 when underway. It should be recognized that the wake is particularly modified by the panel 62 by moving the rear end 70 of the panel 62 laterally outwardly away from the side 10 of the hull 2 in the deployed position relative to in the stowed position. In other words, moving the panel 62 into the deployed position disrupts the flow of water past the hull 2 significantly more than the hull 2 itself, as is the case when the panel 62 is stowed. Similarly, the flow of water is disturbed more by the panel 62 being in the deployed position than in the stowed position (even if the panel 62 is below the waterline WL in each case) due to the rear end 70 extending laterally outwardly more than the front end 68 from the hull 2. Increasing the lateral distance between the lateral end 71 at the rear end 70 of the panel 62 and the side 10 of the hull 2 generally increases this effect, which is discussed further below. The present inventor has recognized that by incorporating a concaved shape of the second side 66 of the panel 62 at the rear end 70, the water is redirected smoothly without causing excess drag.

It should be recognized that by selectively deploying one panel 62, the water flowing past the corresponding side 10 of the marine vessel 1 is delayed in converging with the water flowing past the other side 10, establishing a substantial, surfable wake. In this manner, the operator may move one panel 62 into the deployed position (which leaving the other panel 62 on the other side 10 of the hull 2 in the stowed position) to generate a surf wake when desired, while easily stowing both panels 62 when the surf wake is no longer needed.

Figure 6:
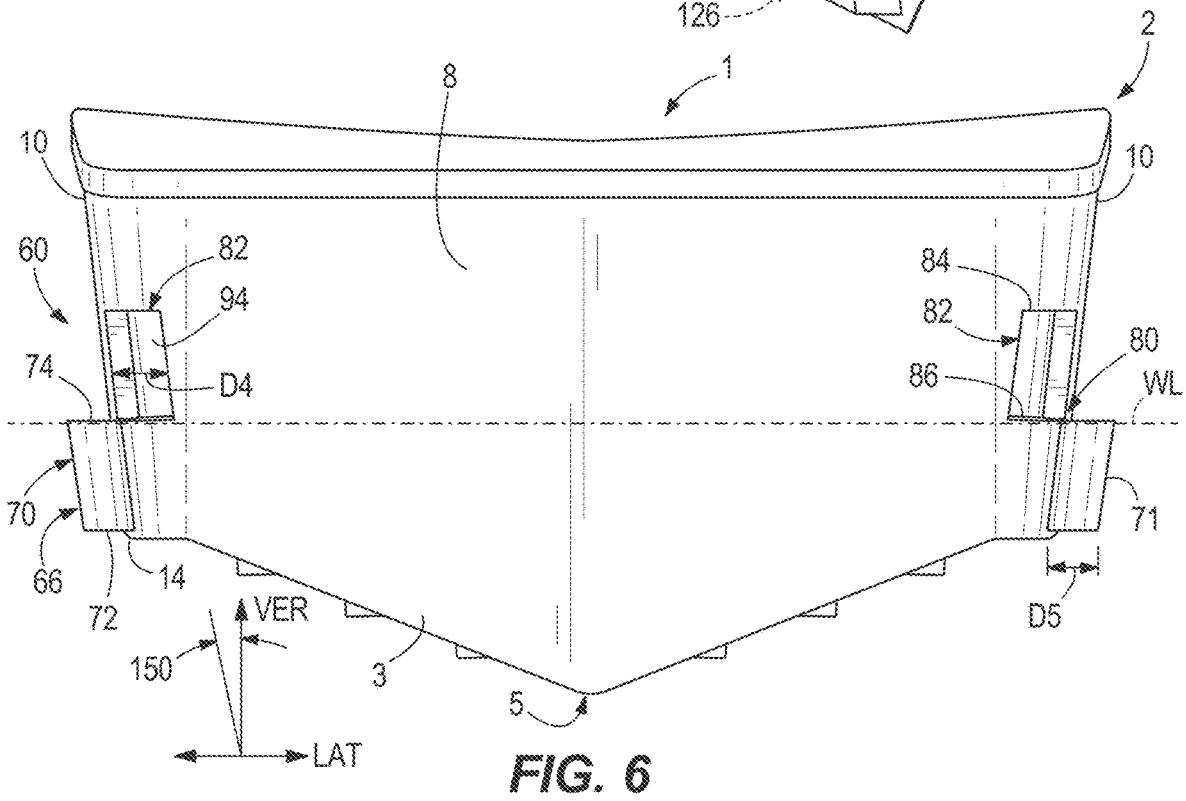
FIG. 6 is a rear view of the marine vessel of FIG. 2 with the devices in deployed positions.

In addition to directing water laterally away from one side 10 of the hull 2, the device 60 may be configured to also create lift and roll for the hull 2. As shown in FIG. 6, in certain embodiments the side 10 of the hull 2 and/or the panel 62 are configured such that the second side 66 of the panel 62 is not be exactly vertical between the free end 72 and the fixed end 74, but angles inwardly downward toward the centerline 7 of the hull 2 (here at an angle 150 from the vertical direction). In this configuration, the panel 62 not only directs water laterally outwardly away from the hull 2, but also downwardly into the water, creating lift and roll for the hull 2 and further exacerbating the size of the surf wake generated. Additionally, or in the alternative, the rear end 70 of the panel 62 may be angled downwardly to generate the same effect of lift and roll. In other words, the rear end 70 at the fixed end 74 is longitudinally closer than the free end 72 to the bow 4. In addition to creating lift and roll, the present inventor has recognized that this configuration is advantageous in that it generates less turbulence in the redirected flow of water.

Through experimentation and development, the present inventor has recognized additional benefits for incorporating additional safety features into the devices 60 disclosed herein. For example, attempting to move the panel 62 away from the deployed position while the marine vessel 1 is underway can generate extreme forces on the rotary actuator 100 during operation. Accordingly, the HCM 34 (FIG. 1) and/or central control module 32 may be configured to "lock-out" operation of the rotary actuator 100 when the marine vessel 1 is moving at a velocity exceeding a predetermined threshold (e.g., 5 mph, or idle RPM). The velocity may be inferred from the RPM of the powerheads 22 as measured by the powerhead speed sensors 24, by GPS, or by other methods presently known in the art (e.g., a pitot tube). The lock-out may also be active whenever a Surf Mode is enabled in the CCM 32. For example, the system may require the user to enable a Surf Mode to add ballast or actuate the device 60 to ensure no operation is done when the marine vessel is already underway. Additionally, the present inventor has recognized that in certain configurations it is beneficial to prevent the devices 60 on each side of the marine vessel from being deployed at the same time.

Similarly, the present inventor has recognized that providing physical locking devices for retaining the panel 62 in the stowed can be advantageous to reduce strain on the rotary actuator 100 and to ensure that the panel 62 remains flush with the side 10 of the hull 2 when stowed. FIG. 5 shows the device 60 in the deployed position. The ramped front end 68 of the panel 62 causes water to be diverted laterally away from the side 10 of the hull 2 when the marine vessel 1 is underway, which also forces the panel 62 laterally towards the side 10 and helps to retain the panel 62 in the deployed position. However, the panel 62 is above the waterline WL when in the stowed position. Therefore, the present inventor has recognized that it is advantageous to provide a lock 120 to keep the panel 62 in the stowed position.

As shown in FIG. 5, the lock 120 is provided between the hull 2 and the panel 62, here being a bolt-type lock. In particular, the lock 120 has a solenoid 122 that moves a plunger 124 vertically up and down within the side 10 of the hull 2. When the panel 62 is in the stowed position (i.e., is positioned within the recess 82 in the side 10 of the hull 2), the lock 120 engages to lock the panel 62 by moving the plunger 124 downwardly and into a recess 126 formed in the free end 72 of the panel 62. The plunger 124 therefore prevents the panel 62 from pivoting about the pivot axis PA to move out of the stowed position until the plunger 124 is retracted upwardly by the solenoid 122. In certain embodiments, the lock 120 is configured to automatically engage to lock the panel 62 when the encoder 110 of the rotary actuator 100 reads a rotational position corresponding to the panel being in the stowed position (after being controlled to move towards the stowed position). The lock 120 is then automatically disengaged when the operator uses the panel controls 112 (FIG. 1) to move the panel 62 from the stowed position to the deployed position. In other embodiments, the lock 120 is manually engaged and disengaged, such as via a physical cable connected to the plunger 124. In still further embodiments, the lock 120 is engaged and disengaged manually, but electronically, such as via a dedicated lock switch at the helm 34 (FIG. 1).

Figure 7:
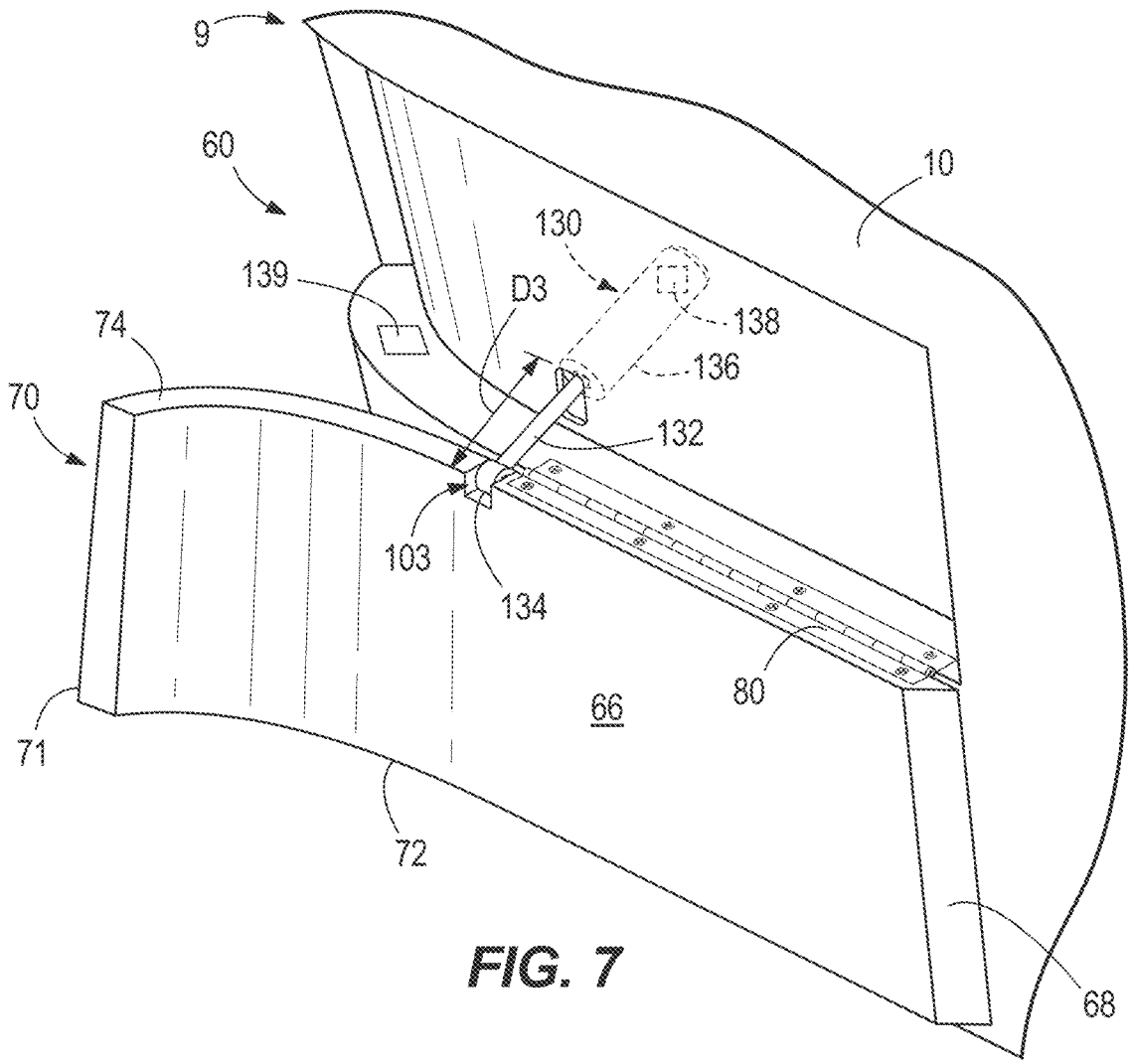
FIG. 7 shows the device of FIG. 4 assembled and with a second type of actuator.

FIG. 7 depicts a device 60 having a panel 62 similar to that of FIG. 5, but incorporating a second type of actuator, now a linear actuator 130. An example of a linear actuator available in the market is the 102 HD/XD Actuator produced by Lenco Marine (part number 15060-001). The linear actuator 130 has a rod 132 with an end 134 that extends away from a housing 136 by a distance D3. The end 134 is rotatably coupled to the panel 162, shown here to be positioned within a notch 103 in the fixed end 74 of the panel 62 as discussed above. The end 134 has an opening (not shown) through which the rod 132 is rotatably coupled to the panel 62, for example via a bolt, a pin, or an axle. Actuating the linear actuator 130 (via the control mechanisms discussed above) changes the distance D3 between the end 134 of the rod 132 and the housing 136. It should be recognized that in the configuration shown, increasing the distance D3 of the linear actuator 130 causes the panel 62 to move towards the deployed position of FIG. 7, whereas decreasing the distance D3 causes the panel 62 to move towards the stowed position (e.g., FIG. 2). An encoder 138 within the linear actuator 130 is again used to limit the operation of the linear actuator 130 in the same manner as the encoder 110 of the rotary actuator 100 discussed above. Additionally, or alternatively, a separate sensor 139 can be used to detect when the panel 62 is in the stowed position (and likewise, another to detect when the panel 62 is in the deployed position), which for example may be Hall-effect sensors or mechanical limit switches known in the art.

Figure 8:
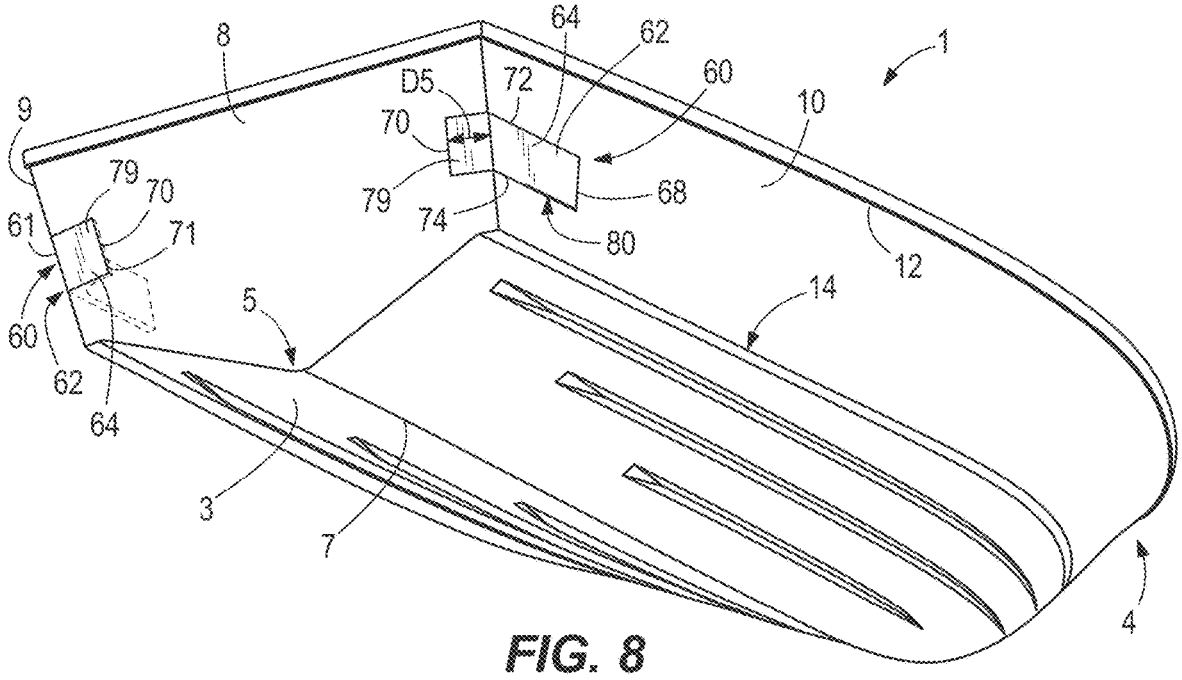
FIG. 8 is a rear perspective view of another embodiment of a marine vessel with devices for modifying a wake according to the present disclosure in stowed positions.
Figure 9:
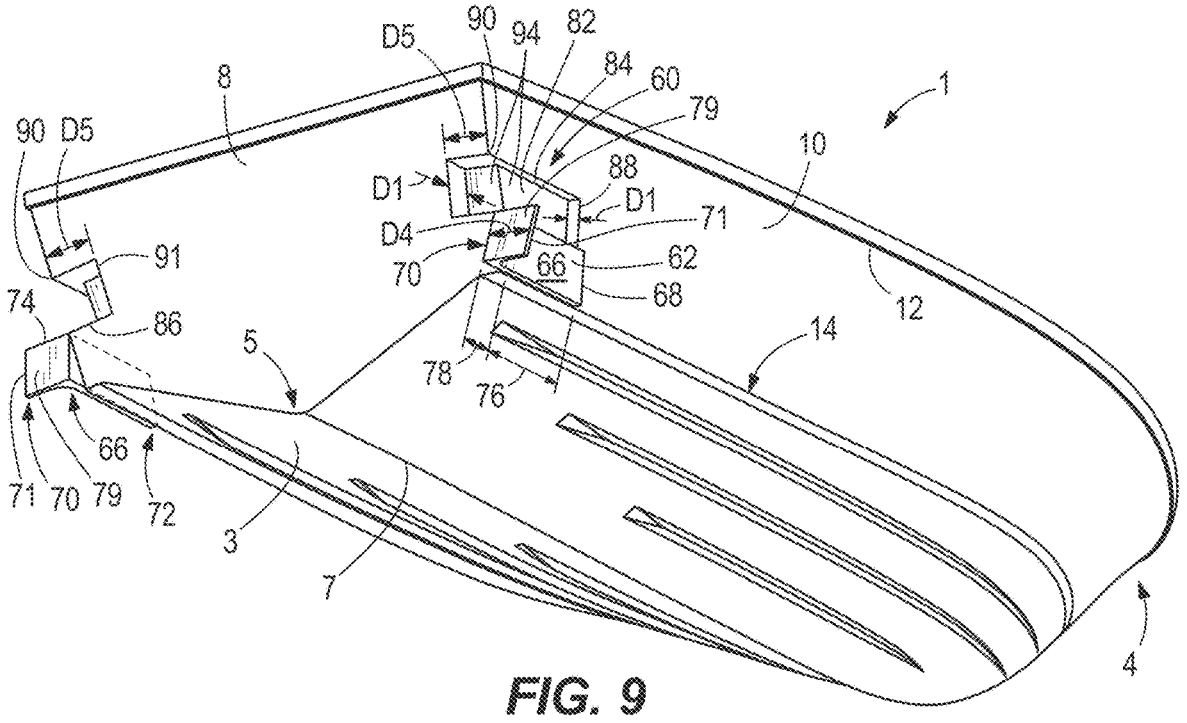
FIG. 9 shows the marine vessel of FIG. 8 with the devices in deployed positions.

FIGS. 8 and 9 depict another embodiment of device 60 in a stowed and deployed position similar to FIGS. 2 and 3, but with a different panel 62 to correspond to a differently shaped hull 2. In particular, the hull 2 has an aft corner 9 that is sharp relative to the hull 2 of FIG. 2, the transom 8 and the side 10 meeting at approximately a hard 90-degree angle. The first side 64 of the panel 62 mirrors this shape of the aft corner 9. In particular, the panel 62 includes a third section 79 that extends perpendicularly outwardly relative to the first section 76 to a lateral end 71. The lateral end 71 extends a distance D5 from the first side 64 of the panel 62. The first section 76 and the second section 78 remain substantially similar to that of panels 62 previously discussed, being relatively planar in the first section 76 and having a concaved surface in the second section 78 on the second side 66 of the panel 62. The recess 82 formed in the side 10 again wraps around the aft corner 9 of the hull 2 and into the transom 8. Within the transom 8, the recess 82 extends laterally inwardly from the side 10 by a distance D4 corresponding to the distance D5 of the third section 79 of the panel 62.

In the embodiment shown, the inner surfaces 94 of the recess 82 are substantially planar in both the side 10 and in the transom 8, despite the second side 66 of the panel 62 having a concaved shape. Additionally, the recess 82 in the transom 8 has a depth D1 that is greater than the depth D1 of the recess 82 in the side 10 at the front end 88. However, other configurations are also contemplated by the present disclosure. For example, the concaved shape of the second side 66 of the panel 62 may be configured to mirror the hull, and/or to provide the smoothest flow of water when in the deployed position. Likewise, the thickness D1 not only corresponds to the recess 82 in the hull, but also to ensure adequate structure where the panel 62 will experience the greatest loads (e.g., aftward portions, and/or near where the actuator is coupled to the panel 62). The panels 62 are movable between the stowed position and the deployed position via a rotary actuator 100 or a linear actuator 130 in the manner described above.

Figure 10:
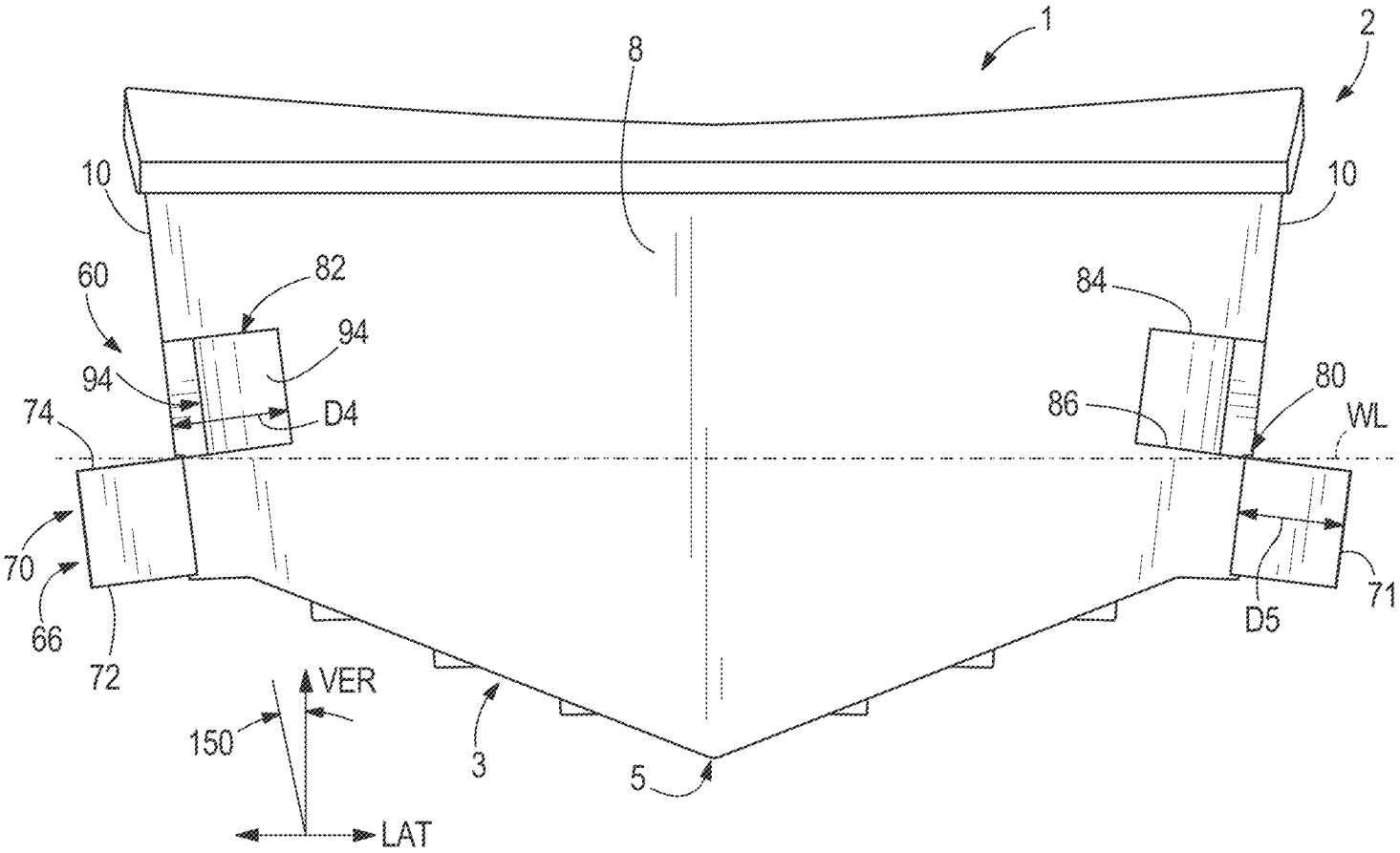
FIG. 10 is a rear view of the marine vessel as shown in FIG. 8.

With reference to FIG. 10, the second side 66 of the panel 62, at least at the rear end 70, is angled at an angle 150 away from the vertical direction so as to divert water downwardly in addition to laterally outwardly, generating lift and roll for the marine vessel 1 when underway, as discussed above.

Figure 11:
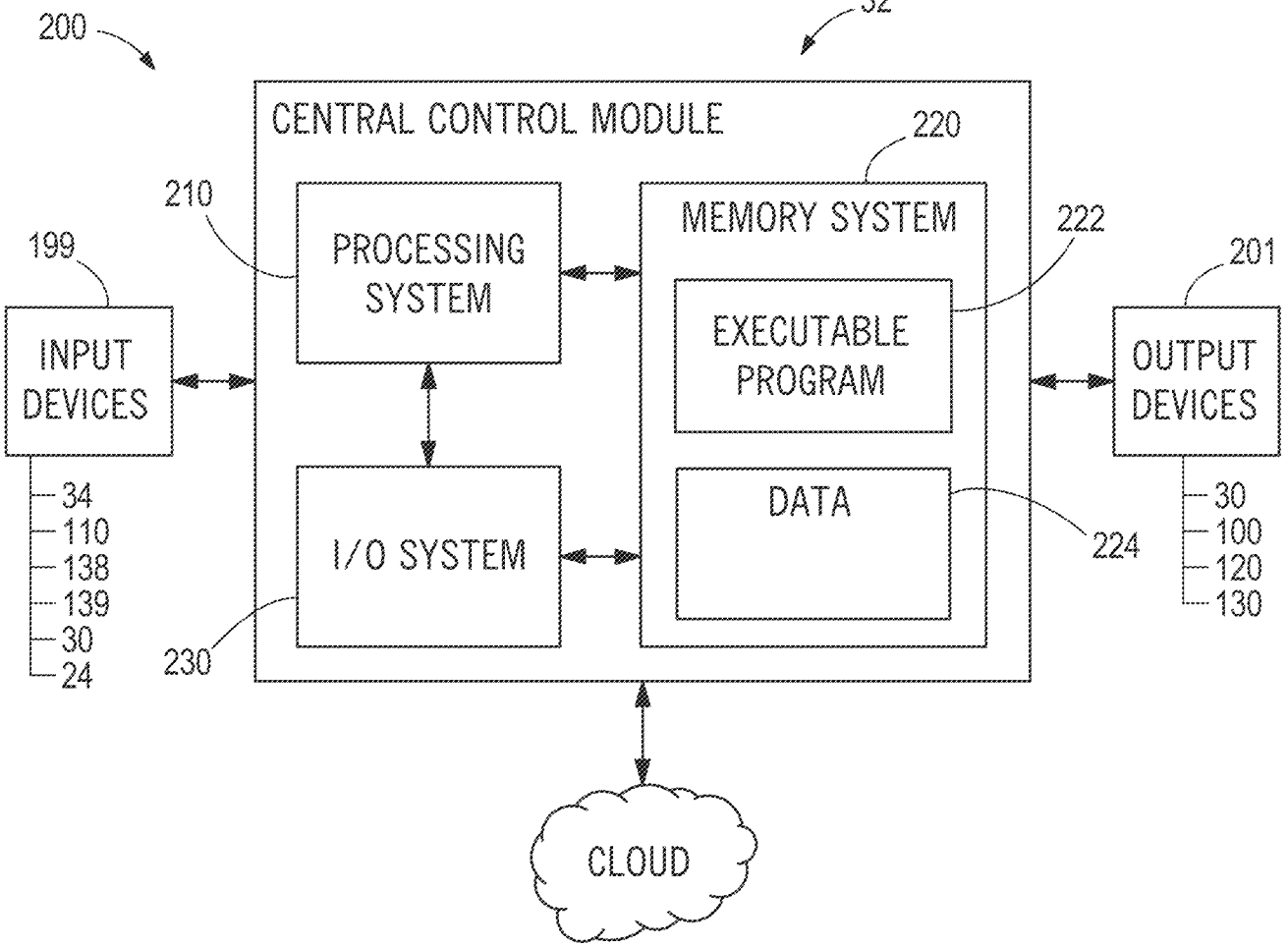
FIG. 11 is a schematic view of a control system for operating devices for modifying a wake according to the present disclosure.

FIG. 11 provides additional information regarding the central control module 32 discussed above, which is part of an overall control system 200. Similar structures shown within the central control module 32 may be provided within the helm control module 34 and/or engine control modules 30. The central control module 32 includes a processing system 210, which may be implemented as a single microprocessor or other circuitry, or be distributed across multiple processing devices or sub-systems that cooperate to execute the executable program 222 from the memory system 220. Non-limiting examples of the processing system include general purpose central processing units, application specific processors, and logic devices. A person of ordinary skill in the art will recognize that these subsystems may also be present within additional CCMs 32 (as applicable), the HCM 34, and/or engine control modules 30 or other controllers within the marine vessel 1. Multiple control modules are communicatively connected and/or cooperate together to form the control system 200, including the central control module 32, one or more engine control modules 30 each associated with a propulsor 20, and/or other controllers such as engine or motor controllers, etc. However, additional and/or different controllers in alternate configurations may also be considered to be part of the control system 200.

The central control module 32 further includes a memory system 220, which may comprise any storage media readable by the processing system 210 and capable of storing the executable program 222 and/or data 224, such as software configured to execute the control methods and the steering maps described herein. The memory system 220 may be implemented as a single storage device or may be distributed across multiple storage devices or sub-systems that cooperate to store computer readable instructions, data structures, program modules, or other data. The memory system 220 may include volatile and/or non-volatile systems and may include removable and/or non-removable media implemented in any method or technology for storage of information. The storage media may include non-transitory and/or transitory storage media, including random access memory, read only memory, or any other medium which can be used to store information and be accessed by an instruction execution system, for example. Threshold data, including the velocity threshold discussed above for locking out actuation of the actuator, may be stowed in the data 224 of the memory system 220.

An input/output (I/O) system 230 provides communication between the control system 200 and peripheral devices, such as input devices 199 and output devices 201, many of which were discussed further above. Examples of input devices 199 include the engine control modules 30, helm control module 34, powerhead speed sensors 24, encoder 138 and sensor 139 of the rotary actuator 100 and the linear actuator 130, respectively, and the position sensor 129. Examples of output devices 201 include the engine control modules 30, rotary actuator 100, linear actuator 130, and lock 120. In practice, the processing system 210 loads and executes an executable program 222 from the memory system 220, accesses data 224 stored within the memory system 220, and directs the marine vessel 1 and the devices 60 to operate as described herein.

A person of ordinary skill in the art will recognize that these subsystems within the control system 200 may be implemented in hardware and/or software that carries out a programmed set of instructions. As used herein, the term "controller" or "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A central control module may include memory (shared, dedicated, or group) that stores code executed by the processing system. The term "code" may include software, firmware, and/or microcode, and may refer to programs, routines, functions, classes, and/or objects. The term "shared" means that some or all code from multiple central control modules may be executed using a single (shared) processor. In addition, some or all code from multiple central control modules may be stored by a single (shared) memory. The term "group" means that some or all code from a single central control module may be executed using a group of processors. In addition, some or all code from a single central control module may be stored using a group of memories. One or more central control module 32 may together constitute a control system 200.

A person of ordinary skill in the art will understand in light of the disclosure that the control system 200 may include a differing set of one or more control modules, or control devices, which may include engine control modules 30 for each propulsor 20, one or more thrust vector control modules (TVMs), one or more helm control modules 34, and/or the like. Likewise, certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices.

The control system 200, and/or each of the control modules therein, communicates with each of one or more components on the marine vessel 1 via a communication link CL, which can be any wired or wireless link. The illustrated communication link CL connections between functional and logical block components are merely exemplary, which may be direct or indirect, and may follow alternate pathways. The control system 200 is capable of receiving information and/or controlling one or more operational characteristics of devices 60 and various sub-systems by sending and receiving control signals via the communication links CL. In one embodiment, the communication link CL is a controller area network (CAN) bus, such as a CAN Kingdom network; however, other types of links could be used which may utilize wired or wireless communication means. It will be recognized that the extent of connections and the communication links CL may in fact be one or more shared connections, or links, among some or all of the components in the marine vessel 1. Moreover, the communication link CL lines are meant only to demonstrate that the various control elements are capable of communicating with one another, and do not represent actual wiring connections between the various elements, nor do they represent the only paths of communication between the elements. Additionally, the marine vessel 1 may incorporate various types of communication devices and systems, and thus the illustrated communication links CL may in fact represent various types of wireless and/or wired data communication systems. It will be recognized that the arrows shown are merely exemplary and that communication may flow in multiple directions.

Returning to FIG. 1, the present inventor has recognized that coupling the panel 62 to the side 10 of the hull 2, rather than to the transom 8 or underside 3 as presently known, prevents interference with the propulsors 20, and with likewise inboard motors, stern drives, rudders, or traditional trim tabs mounted on the transom or underside. Additionally, the presently disclosed devices 60 allow a greater number of propulsors to be positioned at the stern 6 that possible when surf tabs presently known in the art, which extend longitudinally rearwardly from the transom 8. The devices 60 disclosed herein offer a robust design for selectively generating wake in which the actuators (e.g., rotary actuator 100) are protected from the elements, and the panel 62 effectively disappears into the side 10 of the hull 2 when not in use. This provides an aesthetically pleasing design for the operator, as well minimizing drag and protecting the various components from contact and fouling.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A device for modifying a wake of a marine vessel having a hull, the hull extending longitudinally between a bow and a transom and laterally between sides, the sides each extending vertically between a top and a bottom, the device comprising a panel movably coupled to one of the sides of the hull and movable into and between a stowed position and a deployed position, wherein in the stowed position the panel extends along the one of the sides of the hull and a first side of the panel face the hull, wherein in the deployed position the first side faces away from the hull, and wherein the panel is configured to extend laterally farther from the hull in the deployed position than in the stowed position such that moving the panel therebetween causes the panel to modify the wake of the marine vessel.

2. The device according to claim 1, wherein the panel is pivotable between the deployed position and the stowed position.

3. The device according to claim 1, further comprising an actuator configured to pivot the panel into and between the stowed position and the deployed position.

4. The device according to claim 1, further comprising a lock engageable to prevent the panel from pivoting away from the stowed position.

5. The device according to claim 1, wherein the panel comprises a ramped front end configured to divert water laterally away from the one of the sides of the hull when the panel is in the deployed position and the marine vessel is underway.

6. The device according to claim 1, wherein the panel extends longitudinally between a front end and a rear end, wherein the rear end is longitudinally closer than the front end to the transom and the front end is laterally closer than the rear end to the one of the sides of the hull when in the panel is in the deployed position so as to divert water laterally away from the one of the sides of the hull when the marine vessel is underway.

7. A device for modifying a wake of a marine vessel having a hull, the hull extending longitudinally between a bow and a transom and laterally between sides, the sides each extending vertically between a top and a bottom, the device comprising a panel movably coupled to one of the sides of the hull and movable into and between a stowed position and a deployed position such that in the stowed position the panel extends along the one of the sides of the hull and the panel moves laterally outwardly away from the one of the sides of the hull when moving toward the deployed position, in particular so that moving the panel from the stowed position to the deployed position causes the panel to modify the wake of the marine vessel, wherein the panel has a first side and an opposite second side spaced laterally apart and is pivotable such that in the deployed position the first side faces the hull and the second side faces away from the hull, and in the stowed position the second side faces the hull and the transom and the first side faces away from the hull.

8. A marine vessel having a modifiable wake, the marine vessel comprising:

a hull extending longitudinally between a bow and a transom and laterally between first and second sides, the first and second sides each extending vertically between a top and a bottom; and two panels movably coupled to the first and second sides of the hull, respectively, each being movable into and between a stowed position and a deployed position, wherein in the stowed positions the two panels extend along the first and second sides of the hull and first sides of the two panels face the hull, respectively, wherein in the deployed positions the first sides face away from the hull, and wherein the two panels are configured to extend laterally farther from the hull in the deployed positions than in the stowed positions such that moving either of the two panels therebetween modifies the wake of the marine vessel.

9. The marine vessel according to claim 8, wherein recesses are formed in the first and second sides, respectively, and wherein each of the two panels is at least partially positioned in one of the recesses in the first and second sides when in the stowed position.

10. The marine vessel according to claim 9, wherein the first and second sides of the hull have outer surfaces, and wherein the recesses in the first and second sides are configured such that the two panels are flush with the outer surfaces when in the stowed positions.

11. The device according to claim 8, wherein the two panels are configured such that the second side of each of the two panels also faces the transom when in the stowed position.

12. The marine vessel according to claim 11, wherein recesses are formed in the transom, and wherein each of the two panels is at least partially positioned in one of the recesses in the transom when in the stowed position.

13. The marine vessel according to claim 8, further comprising two locks each engageable to prevent one of the two panels from pivoting away from the stowed position, respectively.

14. The marine according to claim 8, further comprising two actuators each configured to pivot one of the two panels into and between the stowed position the deployed position, respectively.

15. The marine vessel according to claim 14, further comprising a controller configured to control the two actuators, wherein the controller is configured to receive a velocity of the marine vessel and to prevent operation of the two actuators when the velocity exceeds a predetermined threshold.

16. The marine vessel according to claim 8, further comprising a propulsor that generates propulsion for the marine vessel, wherein the propulsor is operatively coupled to the hull such that a trim angle of the propulsor relative to the transom is adjustable when the marine vessel is underway and when the two panels are each in the deployed position.

17. The marine vessel according to claim 8, wherein the hull is configured such that the two panels are each positioned above a waterline of the hull when in the stowed position, respectively so as to avoid contact with the water.

18. The marine vessel according to claim 8, wherein each of the two panels pivots at least 150 degrees between the stowed position and the deployed position.

19. The marine vessel according to claim 8, wherein the two panels extend vertically between free ends and an opposite fixed ends pivotally coupled to the first and second sides of the hull, respectively, and wherein the hull is configured such that the free ends of the two panels are vertically at or below the tops of the first and second sides when in the stowed position and vertically at or above the bottoms of the first and second sides when in the deployed position, respectively.

20. The device according to claim 8, wherein the two panel extend longitudinally between front ends and rear ends, wherein when the two panels are in the deployed positions the rear ends are longitudinally closer than the front ends to the transom and the front ends are laterally closer than the rear ends to the first and second sides of the hull so as to divert water laterally away from the first and second sides of the hull, respectively, when the marine vessel is underway.

* * * * *